US009095881B2

(12) United States Patent
Rieck

(10) Patent No.: US 9,095,881 B2
(45) Date of Patent: Aug. 4, 2015

(54) PORTABLE CLASSIFIER SCREEN SHAKER ASSEMBLY

(71) Applicant: Robert Rieck, Mission Viejo, CA (US)

(72) Inventor: Robert Rieck, Mission Viejo, CA (US)

( * ) Notice: Subject to any disclaimer, the term of this patent is extended or adjusted under 35 U.S.C. 154(b) by 0 days.

(21) Appl. No.: 13/998,900

(22) Filed: Dec. 18, 2013

(65) Prior Publication Data

US 2014/0190874 A1 Jul. 10, 2014

Related U.S. Application Data

(60) Provisional application No. 61/848,692, filed on Jan. 9, 2013.

(51) Int. Cl.

| | |
|---|---|
| ***B07B 1/28*** | (2006.01) |
| ***B07B 1/02*** | (2006.01) |
| *B07B 1/36* | (2006.01) |

(52) U.S. Cl.

CPC ... *B07B 1/28* (2013.01); *B07B 1/02* (2013.01); *B07B 1/36* (2013.01)

(58) Field of Classification Search

CPC ..... B07B 1/28; B07B 1/24; B07B 1/343; B07B 1/36; B07B 1/02

USPC ..... 209/363, 364, 235, 412, 309, 365.1, 209/365.2, 365.4

See application file for complete search history.

(56) References Cited

U.S. PATENT DOCUMENTS

| | | | | |
|---|---|---|---|---|
| 1,471,131 | A * | 10/1923 | Adamson | 209/349 |
| 2,074,733 | A * | 3/1937 | Porter | 209/330 |
| 5,495,950 | A * | 3/1996 | Jellum | 209/703 |
| 6,925,961 | B2 * | 8/2005 | Langdale | 119/166 |

* cited by examiner

*Primary Examiner* — Michael McCullough

(74) *Attorney, Agent, or Firm* — I. Michael Bak-Boychuk

(57) ABSTRACT

A sifting screen shaker assembly defined by a generally vertical hollow frame includes a pivotally supported yoke at its base provided with a foot pedal at its apex to articulate a pair of vertical links that are confined in their motion by the convolutions of shaped apertures, with the ends of the links articulating a screen assembly supported within a hinged tray above a collection receptacle in which the sifted particulates passed by the screen assembly are collected while additional particulates are added. The particulates accumulated in the screen assembly are then periodically discarded by articulating the tray around its hinge.

7 Claims, 5 Drawing Sheets

PORTABLE CLASSIFIER SCREEN SHAKER ASSEMBLY

REFERENCE TO RELATED APPLICATIONS

This application obtains the benefit of the earlier filing date of U.S. Provisional Patent Application No. 61/848,692 filed on Jan. 9, 2013.

STATEMENT CONCERNING GOVERNMENT INTEREST

None.

BACKGROUND OF THE INVENTION

1. Field of the Invention

The present invention relates to prospecting devices, and more particularly to a foot operated shaker assembly useful to shake and agitate screen bottomed classifying pans in coordination with the manual shoveling strokes to sift and separate, or classify, the ore bearing soil from any admixed rock aggregate shoveled into the pan.

2. Description of the Prior Art

Precious metals like gold and silver are characterized by their very high specific gravity, fairly low melting temperatures and also a very malleable or ductile material structure that is easily fragmented both by the high temperatures of the tectonic processes and also by the subsequent weathering when these processes cool down. As result the recovery of these highly macerated and finely distributed metals is invariably associated with moving enormous quantities of ore-bearing soil and rock which then needs to be sorted, classified and thereafter processed to a point where the sought metal is finally isolated and then collected. Of course, the back-breaking movement of these huge volumes of the earth's mantle produced all sorts of mechanical, chemical and hydraulic aids which, by their cost, complexity and toxic consequence are mainly useful in larger ground formations rich in the metal deposits, leaving the small, highly localized by alluvial processes, placer deposits to the individual prospector.

Of course, the same high specific gravity and easily fractioned, low strength material structure of the mined precious metal resulted in similar, or even greater, need for mechanical assistance at these smaller placer mining sites and to assist this individual prospector, way out in the desolate terrain where these alluvial concentration sites are often found, various more compact, trailer borne sorting and sifting assemblies were devised as exemplified in the teachings of U.S. Pat. No. 5,421,461 to Razic; U.S. Pat. No. 5,842,578 to Cordeiro; and many others. While suitable for the purposes intended, each of the foregoing examples either entail a substantial storage burden when not in use, and therefore are beyond the capacity of the occasional prospector, or require an elaborate and time consuming assembly at the placer site that often is not justified by its recovery potential.

Significantly, the material structure and density of the mined metal referred to above also focuses the primary processing efforts to those associated with classifying by particle size large volumes of the alluvial concentrate within the placer deposits. As result a variety of smaller, highly compact and easily loaded onto the bed of a pickup truck, screening and classifying mechanisms have been devised exemplified in the teachings of U.S. Pat. No. 5,423,430 to Zaffiro et al.; U.S. Pat. No. 7,591,377 to Puda et al.; U.S. Pat. No. 8,113,355 to Peterson; and many others.

While again suitable for the purposes intended, each of the foregoing entails an interruption of the manual shoveling of the placer's deposits onto one or more of the classifying screens so that the screen or screens may be then agitated or shaken to help pass the properly sized particulates therethrough for collection in buckets or trays, with the shoveling then resumed once more until the screen or screens are fully covered with the accumulated larger particulate loads. Once thus fully loaded the screens need to be lifted and emptied to allow the process to continue. These interruptions prolong to agonizing lengths the already tedious, back-breaking process and a mechanism that utilizes the movement associated with a shoveling stroke to also agitate the screen that is then easily relieved of its accumulated load directly from the shoveling stance is therefore extensively desired and it one such mechanism that is described herein.

SUMMARY OF THE INVENTION

Accordingly, it is the general purpose and object of the present invention to provide a foot articulated support structure for a classifying pan pivotally deployed above a collection receptacle, or bucket, and conformed for coordinated articulation thereof as ore bearing aggregate is shoveled into the pan.

Yet other and further objects of the present invention shall become apparent upon the review of the description that now follows in association with the illustrations appended hereto.

Briefly, these and other objects are accomplished within the present invention by way of an articulated pan support assembly defined by a pair of vertical posts mounted on a base plate in spaced separation to receive a utility bucket between them. The free upper ends of each of the posts includes a generally horizontal outwardly directed pin that are each received in sliding translation within a corresponding, generally S-shaped, slot formed in a corresponding end piece secured to the upper ends of a pair of links each pivotally connected at their respective lower ends to the legs of a generally horizontal V-shaped yoke having its legs supported at their midpoint on a pair of raised fulcrum pivots mounted on the base plate in a spacing relative the posts to align the pivoted link end of each of the yoke legs adjacent the corresponding one of the vertical posts. In this form the pin engagement of each end piece secured to the upper link end then aligns each of the links alongside their corresponding pin engaged post, an alignment further fixed by the radial dimensions of a circular hoop that is fixed by welding in a horizontal, generally opposed, diametric attachment to the respective end pieces.

The radial dimensions of the circular hoop, and also a further, equally Dimensioned, overlying ring hinged at one point of its periphery to the periphery of the hoop, are each conformed to engage in suspension the peripheral edge of a pan provided with a screened bottom into which the prospected soil and particulates are shoveled while a foot pedal mounted on the yoke tongue is concurrently depressed to articulate the yoke legs about their corresponding fulcrum pivots. Thus the shoveling motion that deposits the soil particulates on a screen aligned right over the collection bucket, by its own weight transfer, is also useful to impart a concurrent reciprocal articulation of the pan as the convolved grooves in each of the end pieces translate over the pins received therein, shaking the particulates collected in the pan to advance the smaller ones thereof through the screening for collected in the bucket positioned below while the unwanted larger particulates accumulate on the screen. Once the screen is fully loaded by the larger particulates the pan supporting ring with the pan resting on it may simply be periodically pivoted about its peripheral hinge to discard the unwanted pan contents.

In this manner a single prospector does not need to alternate between shoveling the material onto the screen and then shaking the screen to assist in its particle size classification, and can therefore continue loading the elevated pan to its capacity at its raised, waist high, deployment and then simply discard the larger residue on the screen by pivoting the loaded pan about its hinge. Significantly, these same mechanical attributes that provide the foregoing advantages also align the prospector's face and breathing away from the agitated soil and the large clouds of dust that are created by the agitation as the classification task continues, a benefit that is particularly useful in hot, remote settings where effective prospecting is most likely. All these advantages are obtained in a structure that is easily broken down for transport, in which only few parts, e.g., the grooves in the end pieces, are subject to significant wear but which by virtue of their small size may be easily carried as a redundant replacement ring.

DESCRIPTION OF THE PREFERRED EMBODIMENT

Figure 1:
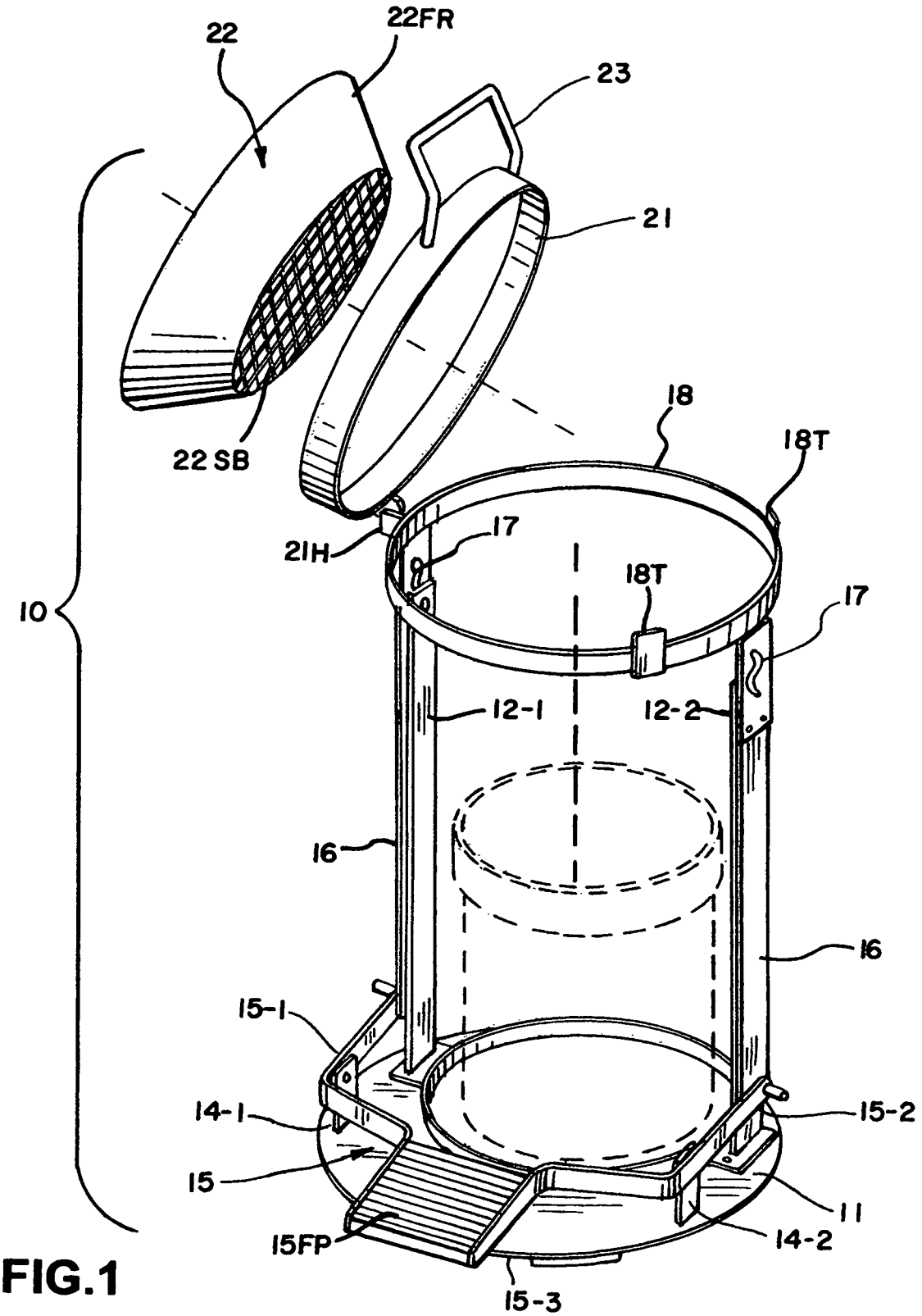
FIG. 1 is a perspective illustration, separated by parts, of the inventive screen shaker assembly in its deployed form.
Figure 2:
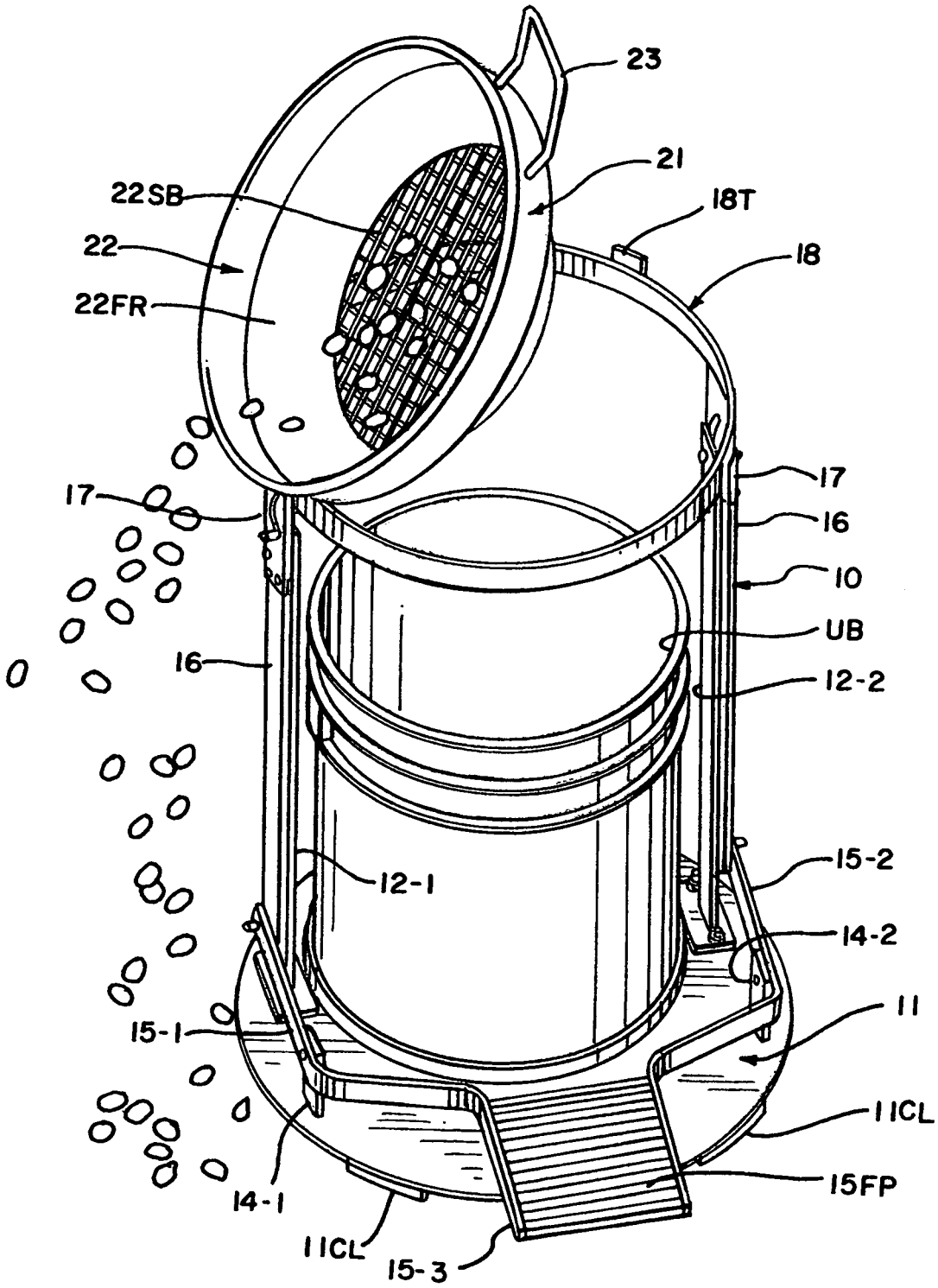
FIG. 2 is yet another perspective illustration of the inventive shaker assembly shown in FIG. 1 articulated to discard the particulate matter collected on the screen thereof.
Figure 3A:
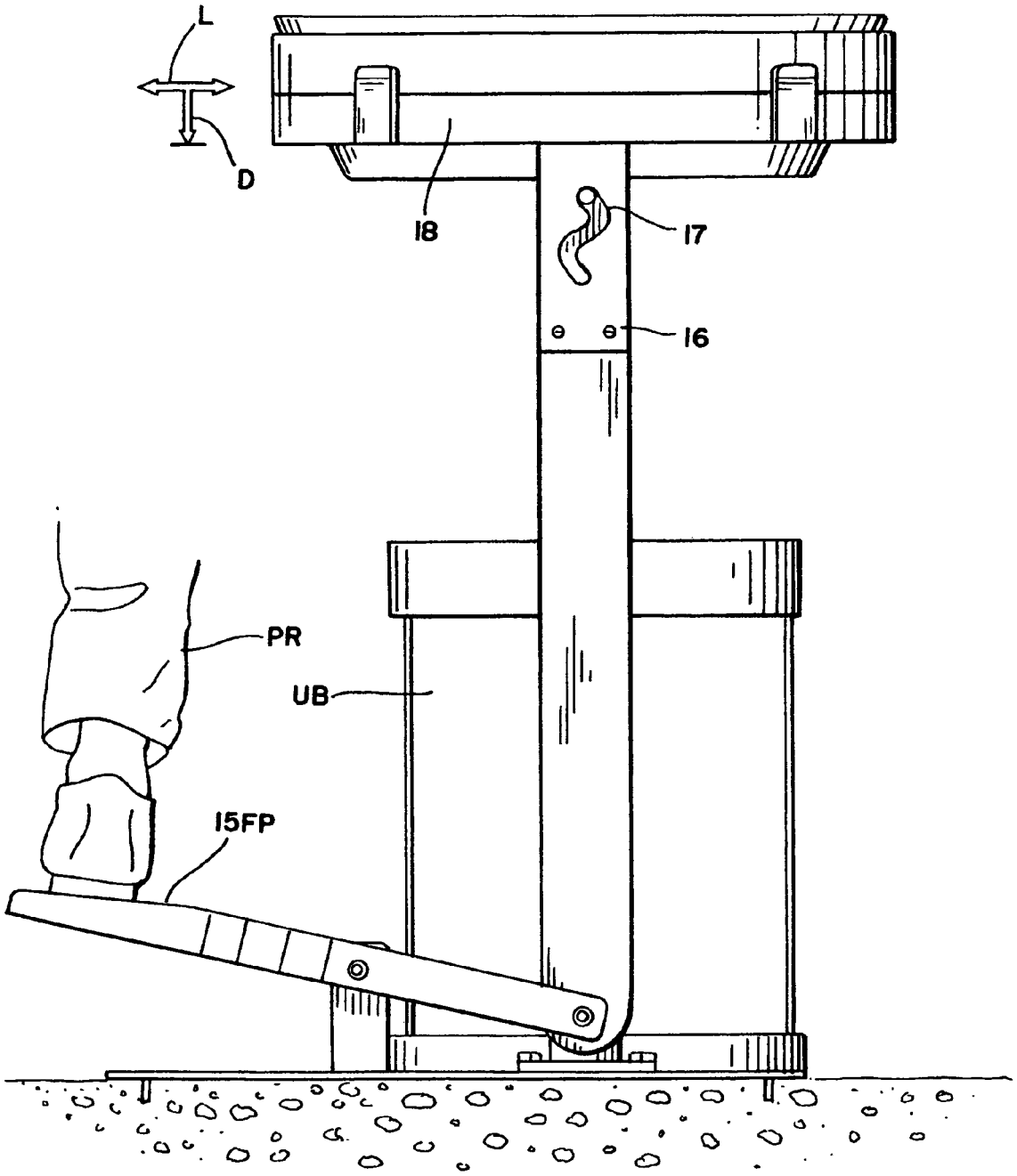
FIGS. 3A and 3B are each side view illustrations of the inventive screen shaker assembly respectively at the upper and lower limits of the articulation stroke thereof.
Figure 3B:
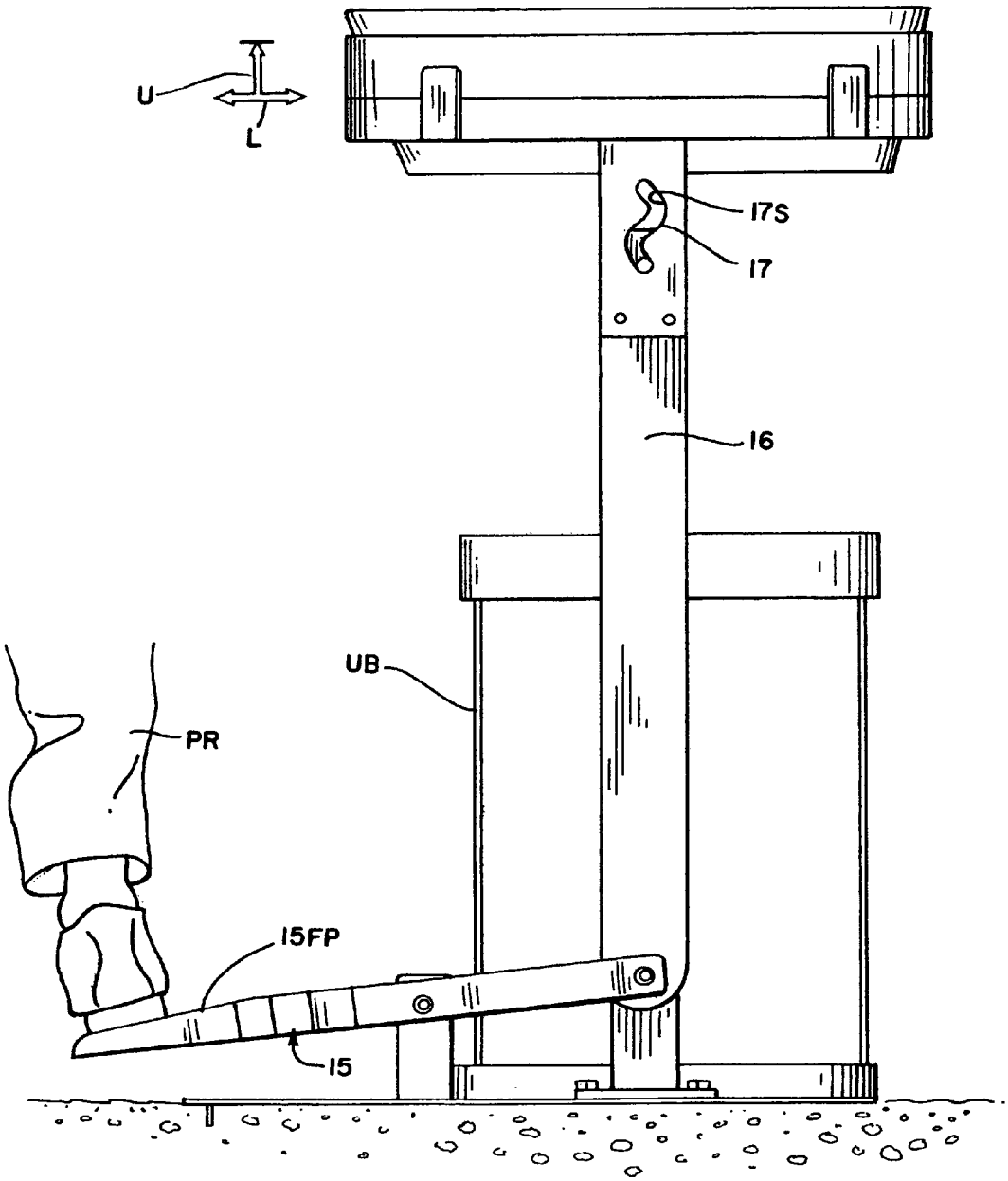
Figure 4:
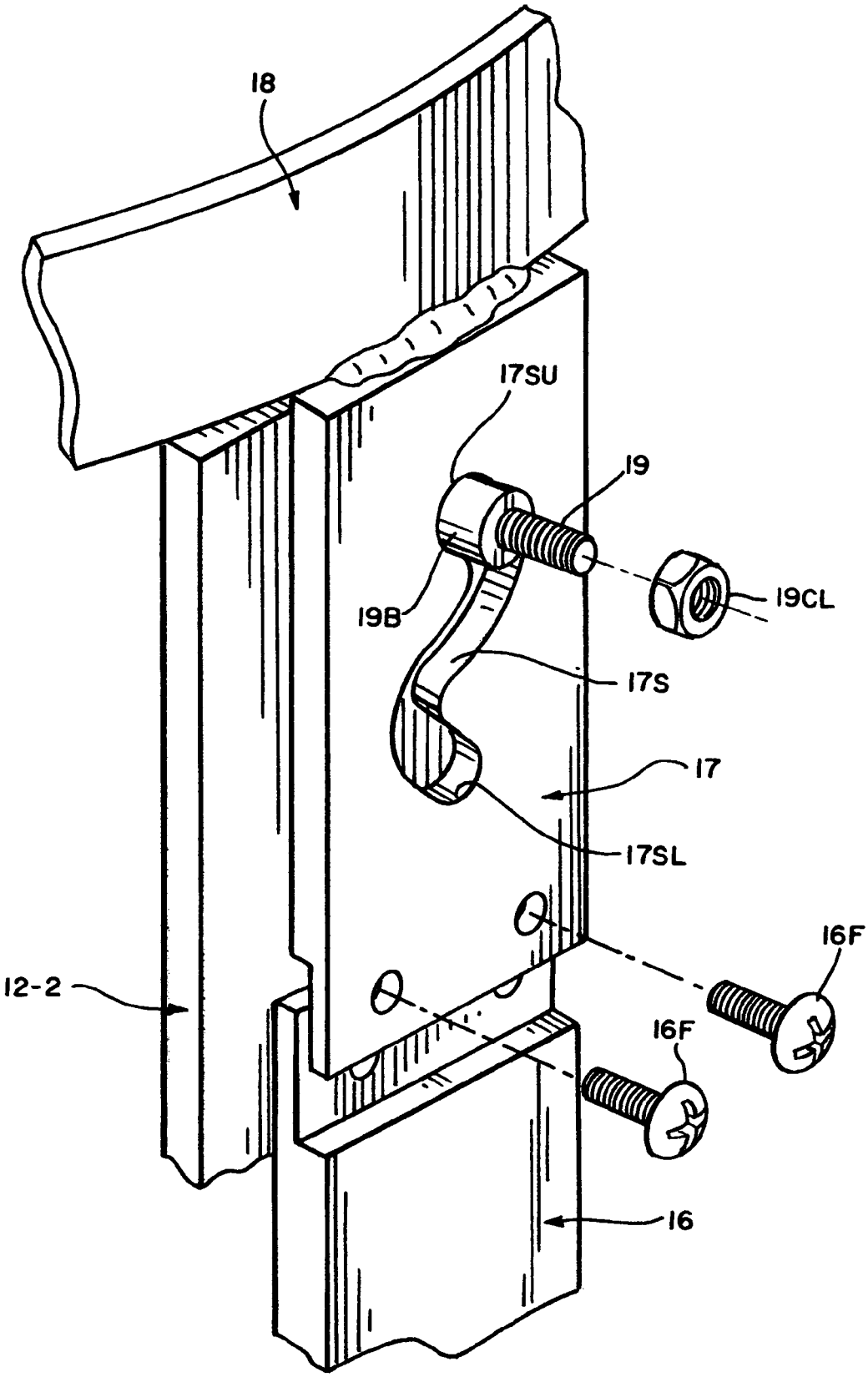
FIG. 4 is a detail illustration in perspective of a reciprocal shaking mechanism useful to impart shaking movement to a screened pan or receptacle in accordance with the present invention.

As shown in FIGS. 1 through 4 the inventive screen shaker assembly, generally designated by the numeral 10, comprises a base plate 11 on which a pair of vertical posts 12-1 and 12-2 are mounted separated from each other by a spacing gap sufficient to accommodate a utility bucket or other similar container UB. Base plate 11 also supports in vertical projection a further pair of fulcrum pivots 14-1 and 14-2 each spaced from the corresponding vertical posts 12-1 and 12-2 and respectively pinned to a corresponding leg 15-1 and 15-2 of a V-shaped yoke assembly 15 to align the leg ends adjacently exterior of the corresponding posts with the opposingly directed yoke tongue 15-3 then provided with a pedal or foot pad 15FP.

The free ends of each of the legs 15-1 and 15-2, as they respectively extend along the exterior of each of the posts 12-1 and 12-2 are each pivotally pinned to the corresponding lower ends of a pair of vertical links 16 aligned generally vertically along the corresponding exteriors of the posts to attach by fasteners 16F at their upper ends to a corresponding pair of end pieces 17 each welded in a diametrically spaced attachment to the lower edge of a circular hoop 18. By particular reference to FIG. 4, each of the end pieces 17 includes a vertically aligned S-shaped groove or slot 17S terminating in an upper end 17SU and a lower end 17SL conformed to receive a bushing 19B surrounding the shank of an outwardly directed pin 19 that extends through the free upper end of the vertical posts 12-1 and 12-2 (and illustrated herein by reference to post 12-2). Like numbered parts functioning in a like manner as herein described, each of the pins 19 includes a threaded end 19TE that is secured by a locknut 19LC to insure a captive engagement of the pins 19 within their corresponding slots 17S as the prospector PR articulates the yoke 15 about its fulcrum pivots 15-1 and 15-2 to impart the up and down articulation of the links 16 as the prospected soil is shaken both up and down and also laterally as illustrated by arrows U and L in FIG. 3B and D and L in FIG. 3A.

A mounting ring 21 equally dimensioned as hoop 18 is hinged by a hinge 21H projecting from its periphery to the periphery of hoop 18 and aligned thereon by a plurality of vertical tabs 18T to form a seat for a screened pan assembly 22 defined by a peripheral frustoconical funneling panel 22FR that surrounds a screened bottom 22SB into which the prospected soil is shoveled by prospector PR and concurrently agitated along with the shoveling strokes, as described above. Once the pan is fully loaded with the unwanted, larger particulates a handle 23 generally diametrically spaced from hinge 22H may be utilized to discard the accumulate, allowing the prospector to accumulate in the bucket UB the more promising small sized particulates that have been promoted by the high specific gravities of precious metals that are preferred in the loading and unloading end impacts against the upper and lower slot ends 17SU and 17SL.

In this manner the tedious, back-breaking effort of selecting the smaller and more dense particulates of a placer deposit is greatly simplified, allowing some vigorous attention to the whole prospecting task. Of course, the provision of cleats 11CL on the underside of the base plate 11 may safeguard against any inadvertent movements of the assembly once the process is commenced, thereby assuring an uninterrupted continuation of the task until the desired results are obtained.

Obviously many modifications and variations of the instant invention can be effected without departing from the spirit of the teachings herein. It is therefore intended that the scope of the invention be determined solely by the claims appended hereto.

It is claimed:

1. A foot actuated apparatus for imparting foot actuated sifting movement to a screen assembly containing granular matter and deployed for concurrent receipt by way of manual translation of additional granular matter, comprising:

a generally vertical support frame defined by an upper and a lower end and including an interior space conformed for receiving a collection receptacle proximate said lower end and a convolved aperture proximate said upper end;

a pivotally mounted pedal assembly including a yoke having the respective separate yoke portions thereof pivotally supported to deploy their common apex as a pedal for said foot actuated movement proximate said lower end of said support frame and having the free end of a selected one of said yoke portions connected to articulate a link in an engaged translation confined within said convolved aperture; and mounting means operatively connected to said link for supporting said screen assembly above said collection receptacle in an alignment for said manual translation of said additional granular matter.

2. Apparatus according to claim 1, wherein:

said mounting means includes a hinged connection to said screen assembly for the pivotal movement thereof to discard outside said interior space such portion of said particulate matter as may remain within said screen assembly.

3. Apparatus according to claim 2, wherein:

said mounting means includes a supporting periphery hinged to a generally conforming structure supporting said screen assembly.

4. Apparatus for imparting sifting movement to a screen assembly containing granular matter therein by way of foot articulation concurrent with the manual translation of additional granular matter into said screen assembly, comprising:

a generally vertical support frame defined by an upper and a lower end provided with a base plate and including an interior space conformed for receiving a collection receptacle proximate said lower end and a convolved aperture proximate said upper end;

a pivotally mounted pedal assembly including a yoke having the separate yoke portions thereof pivotally supported on said base to deploy their common apex as a pedal within said interior space proximate said lower end of said support frame and having the free end of a selected one of said yoke portions connected to articulate a link in an engaged translation within said convolved aperture; and mounting means operatively connected to said link for supporting said screen assembly above said collection receptacle.

5. Apparatus according to claim 4, wherein:

said mounting means includes a hinged connection to said screen assembly for the pivotal movement thereof to discard outside said interior space such portion of said particulate matter as may remain within said screen assembly.

6. Apparatus according to claim 5, wherein:

said mounting means includes a supporting periphery hinged to a generally conforming structure supporting said screen assembly.

7. Apparatus according to claim 6, wherein:

said screen assembly is removable from said conforming structure; and said collection receptacle is removable from said interior space.

* * * * *